United States Patent [19]

Wedge et al.

[11] Patent Number: 4,518,348

[45] Date of Patent: May 21, 1985

[54] FUEL FIRED BURNER ASSEMBLY

[75] Inventors: Philip J. Wedge; Robert C. Bridson, both of Solihull, England

[73] Assignee: British Gas Corporation, London, England

[21] Appl. No.: 536,308

[22] Filed: Sep. 27, 1983

[30] Foreign Application Priority Data

Sep. 29, 1982 [GB] United Kingdom ..... 8227847

[51] Int. Cl.[3] ..... F23Q 3/00

[52] U.S. Cl. ..... 431/265; 431/264; 431/243; 431/166; 431/353; 431/158

[58] Field of Search ..... 431/243, 242, 158, 166, 431/167, 187, 284, 25, 186, 188, 354, 353, 177, 264, 265; 60/736, 758, 737, 39.51 R, 738; 432/178; 239/419.3, 421, 422, 425, 426, 427, 427.5, 434, 434.5

[56] References Cited

U.S. PATENT DOCUMENTS

| | | | |
|---|---|---|---|
| 426,713 | 4/1890 | Collins | 431/243 X |
| 1,588,792 | 6/1926 | Dodge | 431/353 X |
| 2,518,364 | 8/1950 | Owen | 431/166 X |
| 3,145,764 | 8/1964 | Rackley | 431/25 X |
| 3,324,926 | 6/1967 | Jakobi | 431/79 X |
| 3,608,309 | 9/1971 | Hill et al. | 60/758 X |
| 3,695,816 | 10/1972 | Oeppen et al. | 431/166 |
| 4,389,185 | 6/1983 | Alpkvist | 431/243 X |

FOREIGN PATENT DOCUMENTS 1508594 10/1965 Fed. Rep. of Germany ..... 431/166

*Primary Examiner*—Randall L. Green

*Attorney, Agent, or Firm*—Larson and Taylor

[57] ABSTRACT

A fuel fired burner assembly comprises a fuel supply conduit (2) terminating in a nozzle (1) which extends with annular clearance (8*a*) into a combustion chamber (7) located within a tunnel (3). The nozzle (1) is provided with radially directed outlet passages (18) which convey the fuel from the conduit (2) to the clearance (8*a*) where the fuel mixes with air entering the clearance (8*a*) from passages (15), (16) and (8*b*). These passages formed between the tunnel body (3), an outer tunnel sleeve (11) and an intermediate sleeve (14) between the body (3) and the sleeve (11). The nozzle (1) is also provided with a through-going aperture (19) which is located between two adjacent fuel ports (18) and which is axially offset from the nozzle axis. Extending through the aperture (19) with annular clearance (20) is an electrically operated flame detection probe (21) whose electrode tip (22) is disposed within the central section (6) of the tunnel (3). The annular clearance (20) permits a residual supply of air to enter the tunnel (3) from the clearance (8*b*) independently of the clearance (8*a*). The residual air supply flows around the probe (21) to form a cone of flame which enables an electrical current to be passed through the probe (21) between its tip (22) and the metallic grounded tunnel (3).

8 Claims, 3 Drawing Figures

FUEL SUPPLY
AIR SUPPLY
1
2
3
6
7
8a
8b
9
10
11
12
13
14
15
16
18
18
20
21
22
23
24
25
26
27
28
29
30
31

29
27
24
28

FUEL FIRED BURNER ASSEMBLY

FIELD OF THE INVENTION

The present invention relates to a fuel-fired burner assembly particularly though not exclusively for use within a tubular heating element of the type which, in use, is immersed in molten metal salts or fluidised beds of solid particles for conductive heating or which may be used in an enclosed or partially enclosed chamber to provide radiant and convective heating.

SUMMARY OF THE INVENTION

According to the present invention, there is provided a fuel-fired burner assembly including a fuel nozzle, a fuel supply conduit terminating in the nozzle, means for supplying fuel to the conduit, a combustion chamber into which the nozzle extends with clearance, the nozzle being such as to discharge fuel into the clearance between the nozzle and the chamber and having a body with a portion extending radially outwardly from the conduit, means for supplying air towards the nozzle body in the direction of the chamber so that the fuel issuing from the nozzle and the air mix in the clearance before entering the combustion chamber, the nozzle body having an aperture connecting the air supplying means to the chamber independently of the clearance, and a pilot burner for providing a flame within the chamber for igniting the fuel and air mixture entering the chamber from the clearance.

BRIEF DESCRIPTION OF THE DRAWINGS

An embodiment of the present invention will now be particularly described with reference to the accompanying drawings in which.

DETAILED DESCRIPTION OF THE PREFERRED EMBODIMENTS

Figures 1, 3:
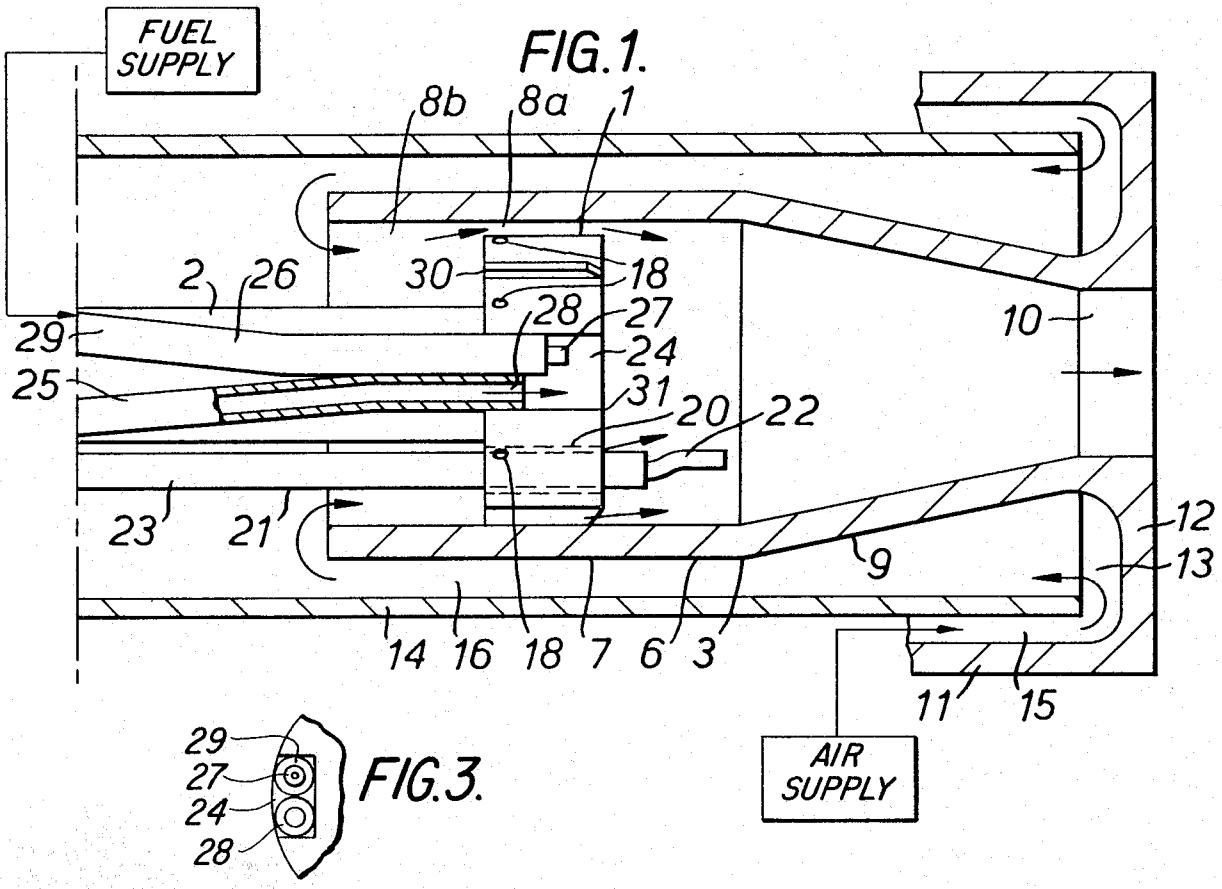
FIG. 1 is a diagrammatic longitudinal section in one plane of the burner assembly and FIG. 2 is a diagrammatic longitudinal section in another plane at right angles to the plane in FIG. 1.
FIG. 3 is a detail portion showing the igniting means.

Referring to the drawings the burner assembly comprises a metal eg steel fuel nozzle 1 mounted on the forward end of a metal eg. steel fuel supply pipe 2 and a metallic tunnel 3 into which the nozzle 1 and the pipe 2, in part, extend with clearance, the tunnel 3 forming a combustion chamber for fuel entering the tunnel 3.

The nozzle 1 is of generally cylindrical shape and is provided with a recess which has a cylindrical portion 4 into which the forward end of the pipe 2 is inserted and which recess terminates in a conical portion 5 although this could be flat. The pipe 2 which, in use conveys fuel gas to the nozzle 1 is welded to the nozzle 1.

The tunnel 3 has a central section 6 comprising a cylindrical rear portion 7 into which the nozzle 1 and part of the pipe 2 extend co-axially so that an annular clearance is formed between the portion 7 and the nozzle 1 and pipe 2. The external diameter of the nozzle 1 is greater than that of the pipe 2 so that the annular clearance 8*a* between the nozzle 1 and the tunnel 3 is less than that 8*b* between the pipe 2 and the tunnel 3.

The central part 6 of the tunnel 3 also comprises a conically shaped front portion 9 terminating in an outlet 10 for the combustion products of the fuel gas.

The tunnel 3, also comprises an outer cylindrical sleeve 11, only part of which is shown, and which is coaxial with the central part 6 of the tunnel 3. The sleeve 11 and the front portion 9 are joined by an annular front wall 12 so that a channel 13 is formed between the sleeve 11 and the central part 6. Extending into this channel 13 but terminating short of the wall 12 is a further cylindrical sleeve 14 which is closed at its rear end (not shown). The sleeve 14 forms an outer annular passageway 15 with the sleeve 11 and an inner annular passageway 16 with the central tunnel part 6. In use, air, preferably preheated, is supplied into the outer passageway 15 and is caused to flow in the direction of the arrows through the inner passageway 16 and towards the nozzle body 1 and through the clearance 8 into the central section 6 of the tunnel 3.

Figure 2:
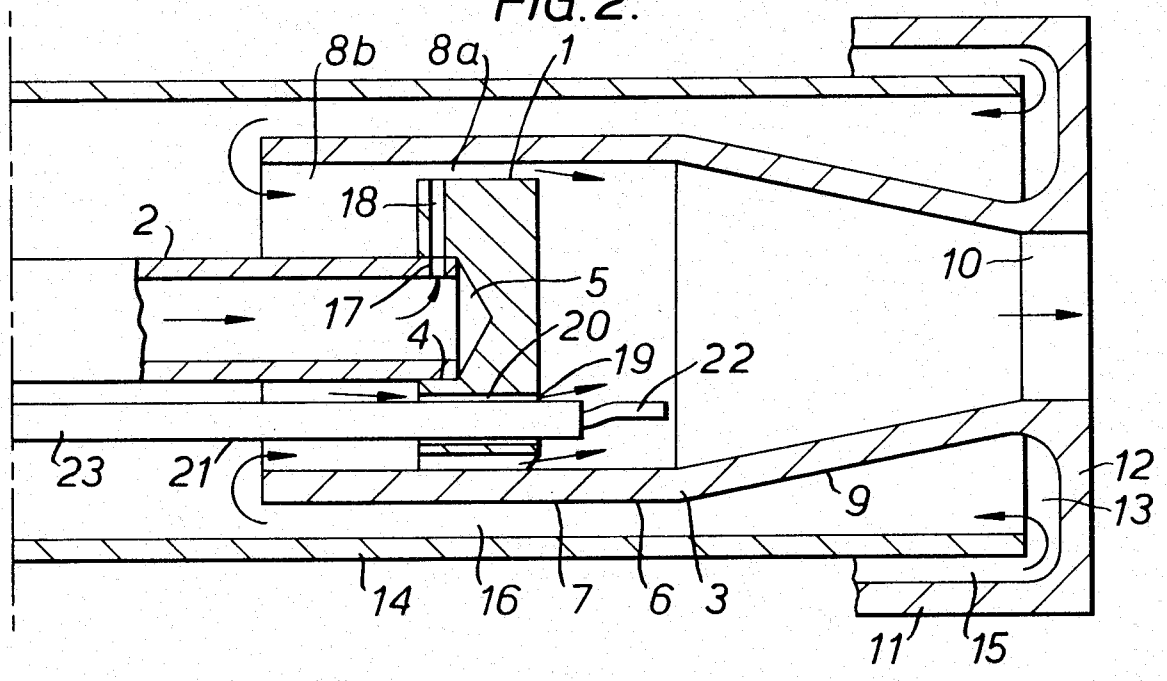

The pipe 2 is provided at points close to its forward end with a number, say six in all, of circumferentially spaced apertures 17 (only one shown in FIG. 2). These apertures 17 communicate with corresponding circumferentially spaced and radially directed ports 18 extending through the body of the nozzle 1 and terminating in the annular clearance 8*a* between the nozzle 1 and the tunnel 3. Thus, in use, fuel conveyed along the fuel supply pipe 2 is caused to issue through the nozzle 1 as a number of radially directed streams into the clearance 8*a* where they meet and mix with the air passing through the clearance 8*a*. The fuel then enters the tunnel 3 as a fuel/air mixture.

Referring to FIG. 1, the nozzle body 1 is also provided with a through-going aperture 19 between two adjacent fuel ports 18, the aperture 19 being aligned with the axis of the nozzle 1 but radially offset therefrom to connect the clearance 8*b* directly with the tunnel 3 totally independently of the clearance 8*a*.

Extending, with annular clearance 20 through the aperture 19 is an electrically operated flame detection probe 21 of conventional design and operation. The probe 21 has an electrode, the tip 22 of which is disposed within the central section 6 of the tunnel 3 while the remainder is sheathed with an insulating material 23 which extends through the aperture 19. The annular clearance 20 between the probe 21 and the wall of the aperture 19 permits a residual supply of air to enter the tunnel 3 from the clearance 8*b* independently of the clearance 8*a*.

Referring to FIG. 1, the nozzle body 1 is also provided with a circumferential recess 24 between two adjacent radial fuel ports 18. Mounted within the recess 24 are located a pilot fuel gas tube 25 and an ignition electrode 26 whose tip 27 is located adjacent the tube outlet 28, the remainder of the electrode 26 being sheathed with an insulating sheath 29. The pilot tube 25 effects ignition of the air/gas mixture entering the central part 6 of the tunnel 3 as is conventional after its own ignition by the electrode 26.

Referring to FIG. 1 the nozzle 1 itself may be supported within the rear portion 7 of the central section 6 by any convenient means. Preferably however, the nozzle body 1 is provided with a number of circumferentially spaced rectangular blades 30 (only one shown) which are welded to the outer surface of the nozzle 1 and are equispaced between the radial fuel gas ports 18. In this way, the nozzle 1 is free to slide longitudinally in the rear portion 7 of the central tunnel section 6, the supply pipe 2 and the conical tunnel portion 9 providing the only limitation to the extent of movement.

In operation of the burner assembly, air, preferably preheated, is conveyed along the passageways 15 and 16 and in the passageway 16 the air effects a cooling of the central section 6 of the tunnel 3. The air then reverses its direction of flow to flow towards the nozzle 1 by way of the clearance 8*a*. Most of the air then enters the clearance 8*b* where the air undergoes an increase in velocity and reduction in pressure because of the reduction in area available for air flow in the clearance 8*a* as compared to the clearance in 8*b*. Fuel in gaseous or vaprous form is induced to flow into the clearance 8*a* as a number of streams via the ports 18 in the nozzle body 1 and the fuel meets and mixes with the air and flows into the rear portion 7 of the tunnel 3 downstream of the nozzle 1. On flowing past the pilot tube 25 from which a pilot flame issues the fuel/air mixture is ignited. On flowing past the nozzle body 1 the fuel/air mixture expands and partially clings to the tunnel 3 so cooling the tunnel 3 before circulating inwards against the downstrean end face 31 of the nozzle 1 and burning within the central section 6 of the tunnel 3 which serves as a combustion chamber.

A residual supply of air by-passes the clearance 8*a* and passes through the aperture 19 in the nozzle 1 by way of the clearance 20 so that the residual air flows around the probe 21 and forms a cone of flame which enables an electrical current to be passed through the probe 21 between its electrode tip 22 and the metallic tunnel 3 which is earthed.

Instead of an electrically operated flame detection probe an ultra-violet flame sensor may be mounted in the assembly with its sensor head aligned with but not obstructing the aperture 20. In this case the residual air flowing through the aperture mixes with the burning gases in the central tunnel section 6 to form a cone of more intense flame over the aperture 20 which can be more readily detected by the sensor.

After combustion, the exhaust gas leaves the tunnel outlet 10 after being accelerated as a result of its passage through the conically tapering portion 9 of the central tunnel section 6. Lower velocities are possible with a parallel tunnel.

The burner assembly can be incorporated into a tubular heater the heater also providing the preheat for the supply of air.

We claim:

1. A fuel-fired burner assembly including a fuel nozzle, a fuel supply conduit connected to and terminating in the nozzle, means for supplying fuel to the conduit, a combustion chamber into which the nozzle extends, the nozzle comprising a nozzle body extending radially outwardly from the conduit in spaced relation to the inner wall of the combustion chamber so as to form a clearance therebetween and including means for spraying fuel supplied by said fuel supplying means directly into the clearance between the nozzle body and the chamber, means for supplying air towards the nozzle body in the direction of the chamber so that the fuel issuing from the nozzle and the air mix in the clearance before entering the combustion chamber, the nozzle body having an aperture connecting the air supplying means to the chamber independently of the clearance, and a pilot burner for providing a flame within the chamber for igniting the fuel and air mixture entering the chamber from the clearance.

2. An assembly as claimed in claim 1 in which the nozzle body has a plurality of passages to supply fuel to the clearance as a plurality of streams.

3. An assembly as claimed in claim 2 in which the passages are arranged in a circular formation around the axis of the nozzle and are radially directed outwardly from the axis of the nozzle.

4. An assembly as claimed in claim 1 in which a portion of the fuel conduit extends with clearance into the combustion chamber.

5. An assembly as claimed in claim 1 in which the pilot burner comprises a pilot fuel tube having an outlet arranged to inject fuel into the chamber and an ignition electrode having a tip located adjacent to the tube outlet and adapted to effect ignition of fuel leaving the tube outlet.

6. An assembly as claimed in claim 5 in which the pilot fuel tube and the electrode are mounted within a recess in the external surface of the nozzle body.

7. An assembly as claimed in claim 1 in which an electrically operated flame detection probe extends through the aperture with clearance to permit a residual supply of air to enter the combustion chamber, the probe having an electrode located within the combustion chamber for forming an electrical connection with an adjacent electrically conducting surface of the assembly.

8. A tubular heating element incorporating a fuel-fired burner assembly comprising a nozzle, a fuel supply conduit connected to and terminating in the nozzle, means for supplying fuel to the conduit, a combustion chamber into which the nozzle extends, the nozzle comprising a nozzle body extending radially outwardly from the conduit in spaced relationship to the inner wall of the combustion chamber so as to form a clearance therebetween and including means for spraying fuel supplied by said fuel supply means directly into the clearance between the nozzle body and the chamber, means for supplying air towards the nozzle body in the direction of the chamber so that the fuel issuing from the nozzle and the air mix in the clearance before entering the combustion chamber, the nozzle body having an aperture connecting the air supplying means to the chamber independently of the clearance, and a pilot burner for providing a flame within the chamber for igniting the fuel and air mixture entering the chamber from the clearance.

* * * * *